US011375876B2

(12) United States Patent
Wolcott, V et al.

(10) Patent No.: US 11,375,876 B2
(45) Date of Patent: Jul. 5, 2022

(54) CLEANING SYSTEM FOR FOOTWEAR OUTER SOLES

(71) Applicants: Frank Bliss Wolcott, V, Saint Augustine, FL (US); Lauren Anne Wolcott, Saint Augustine, FL (US)

(72) Inventors: Frank Bliss Wolcott, V, Saint Augustine, FL (US); Lauren Anne Wolcott, Saint Augustine, FL (US)

( * ) Notice: Subject to any disclaimer, the term of this patent is extended or adjusted under 35 U.S.C. 154(b) by 282 days.

(21) Appl. No.: 16/693,067

(22) Filed: Nov. 22, 2019

(65) Prior Publication Data

US 2021/0153717 A1 May 27, 2021

(51) Int. Cl.

| | |
|---|---|
| ***A47L 23/22*** | (2006.01) |
| ***A47L 23/18*** | (2006.01) |
| ***B08B 3/08*** | (2006.01) |
| ***B08B 1/04*** | (2006.01) |
| ***B08B 1/00*** | (2006.01) |

(52) U.S. Cl.
CPC ..... *A47L 23/22* (2013.01); *A47L 23/18* (2013.01); *B08B 1/001* (2013.01); *B08B 1/04* (2013.01); *B08B 3/08* (2013.01)

(58) Field of Classification Search
CPC ..... A47L 23/22
See application file for complete search history.

(56) References Cited

U.S. PATENT DOCUMENTS

2002/0029432 A1* 3/2002 Graves ..... A47L 23/02 15/112

* cited by examiner

*Primary Examiner* — Jason Y Ko
(74) *Attorney, Agent, or Firm* — Mark Young, PA

(57) ABSTRACT

A cleaning system for outsoles includes a lid, a base, a support structure, a roller contained in the base covered by the lid. A disinfectant pad is provided on the roller. Opening the lid exposes the roller. Outsoles wiped against the disinfectant pad on the roller are disinfected. Optionally, a reservoir in the support structure may contain disinfectant for delivery to the disinfectant pad on the roller as needed. A foot pedal is provided for opening the lid.

20 Claims, 3 Drawing Sheets

CLEANING SYSTEM FOR FOOTWEAR OUTER SOLES

RELATED APPLICATION

This application is a nonprovisional of and claims the benefit of priority of U.S. Provisional Application 62/771,058 filed 24 Nov. 2018, the entire contents of which are incorporated herein by this reference and made a part hereof.

FIELD OF THE INVENTION

This application relates to a footwear cleaning apparatus, and, more particularly, to a footwear cleaning apparatus with a housing containing a roller on which disinfecting cleaning pads are mounted.

BACKGROUND

An easy-to-use device for reliably cleaning and disinfecting the outer soles ("outsoles") of footwear is needed to allow individuals to enter a structure, such as a residence, without contaminating the floors of the structure.

The invention is directed to overcoming one or more of the problems and solving one or more of the needs as set forth above.

SUMMARY OF THE INVENTION

To solve one or more of the problems set forth above, in an exemplary implementation of the invention, a cleaning system for outsoles includes a lid, a base, a support structure, a roller contained in the base covered by the lid. A disinfectant pad is provided on the roller. Opening the lid exposes the roller. Outsoles wiped against the disinfectant pad on the roller are disinfected. Optionally, a reservoir in the support structure may contain disinfectant for delivery to the disinfectant pad on the roller as needed. A foot pedal is provided for opening the lid.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exemplary cleaning system for outsoles according to principles of the invention includes a lid, a base, a roller contained in the covered base and a disinfectant pad on the roller. Opening the lid exposes the roller. Outsoles wiped against the disinfectant pad on the roller are disinfected. Optionally, a reservoir in the support structure may contain additional disinfectant for delivery to the disinfectant pad on the roller as needed.

Figure 1:
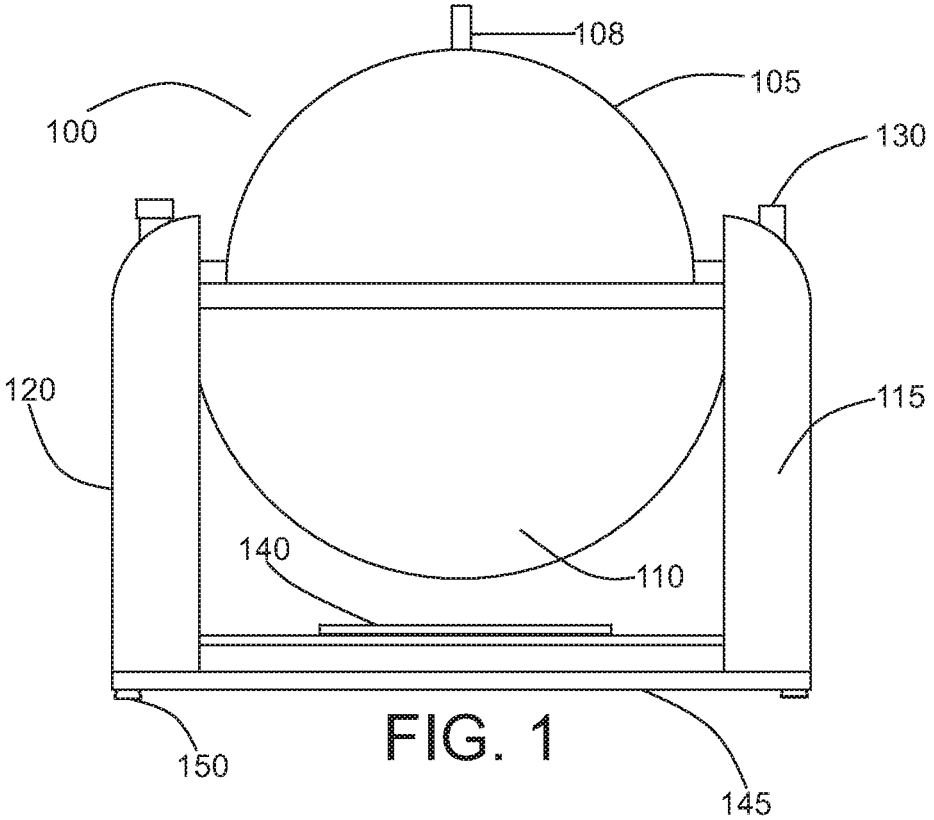
FIG. 1 is a front view of an exemplary cleaning system for outsoles in a closed configuration according to principles of the invention.
Figure 2:
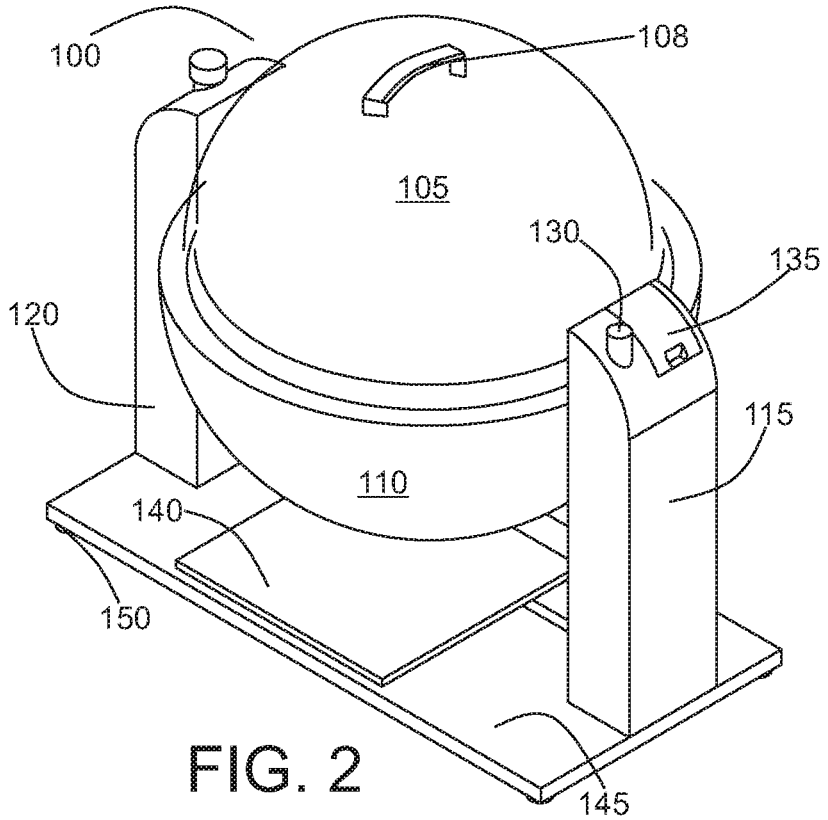
FIG. 2 is a front top perspective view of an exemplary cleaning system for outsoles in a closed configuration according to principles of the invention.
Figure 3:
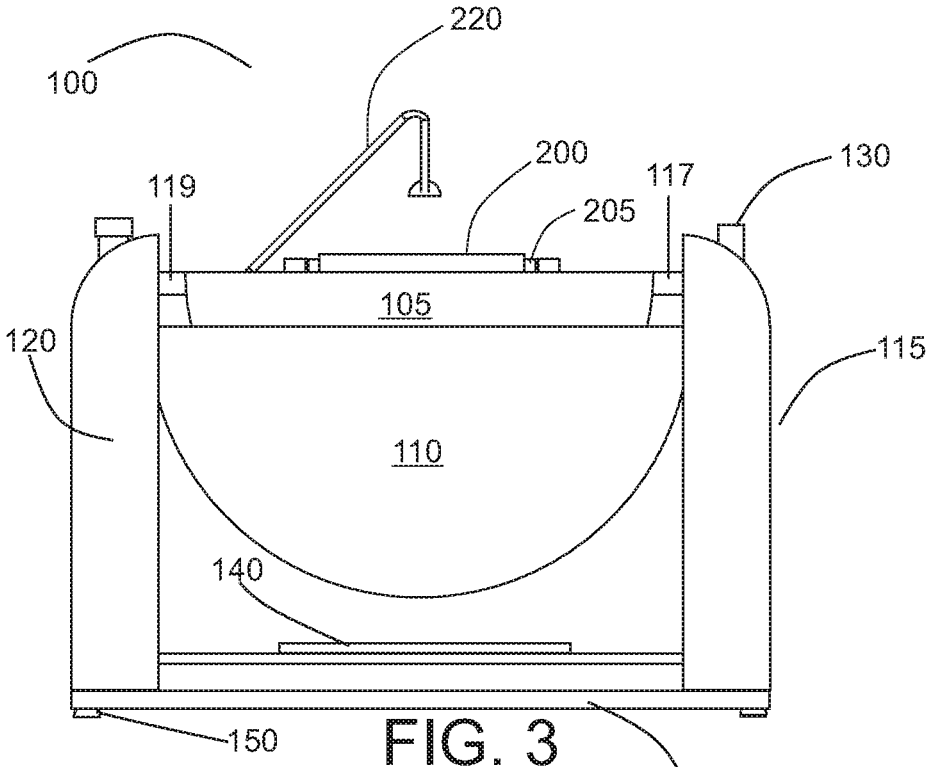
FIG. 3 is a front view of an exemplary cleaning system for outsoles in an open configuration according to principles of the invention.
Figure 4:
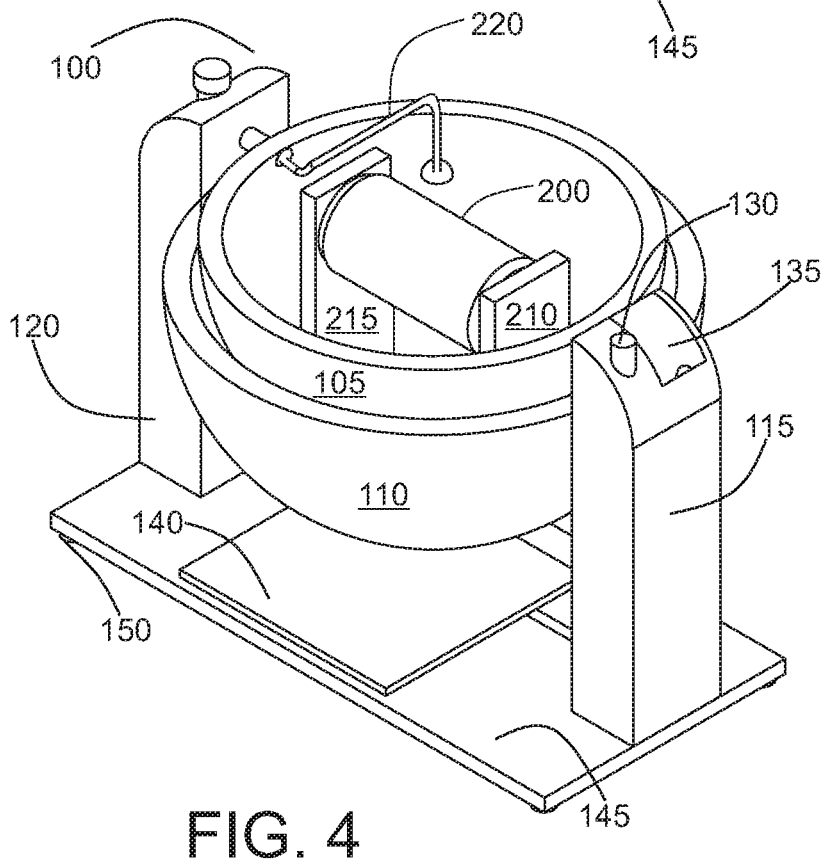
FIG. 4 is a front top perspective view of an exemplary cleaning system for outsoles in an open configuration according to principles of the invention.

FIGS. 1 and 2 conceptually illustrate an exemplary cleaning system 100 for outsoles in a closed configuration according to principles of the invention. The cleaning system includes a housing. The housing includes a bottom 110 and a cover or lid 105. The bottom 110 is supported by a support structure, such as pedestals 115, 120 and base 145. A plurality of feet 150 may be provided at the bottom of the assembly to prevent slipping and scratching of a floor surface. Optionally, the pedestals 115, 120 may contain a reservoir 125 of disinfectant, a spray control 130 and a battery compartment 135. The lid 105 is movable from a closed position, as shown in FIGS. 1 and 2, to an open position as shown in FIGS. 3 and 4. Such movement may be achieved by stepping on a pedal 140 operably coupled to the lid 105, by manually moving the lid 105, such as by using the handle 108, or automatically with a motor coupled to a motion sensor.

FIGS. 3 and 4 conceptually illustrate the exemplary cleaning system for outsoles in an open configuration according to principles of the invention. The lid 105 is nested in the bottom 110. A removable disinfectant pad 200 is applied to the exterior surface of the roller 205. The roller 205 is supported by supports 210, 215. The roller may lock in position or roll slightly in the direction of applied moderate force. Optionally, a sprayer 220 is configured to supply additional disinfectant to the pad 200.

With the lid 105 in an open configuration, the roller 205 and pad 200 are accessible. A user may wipe outsoles against the pad 200 to disinfect the bottoms of the footwear before entering a residence or other building or room. Any debris from the cleaning process is contained in the housing.

Figure 5:
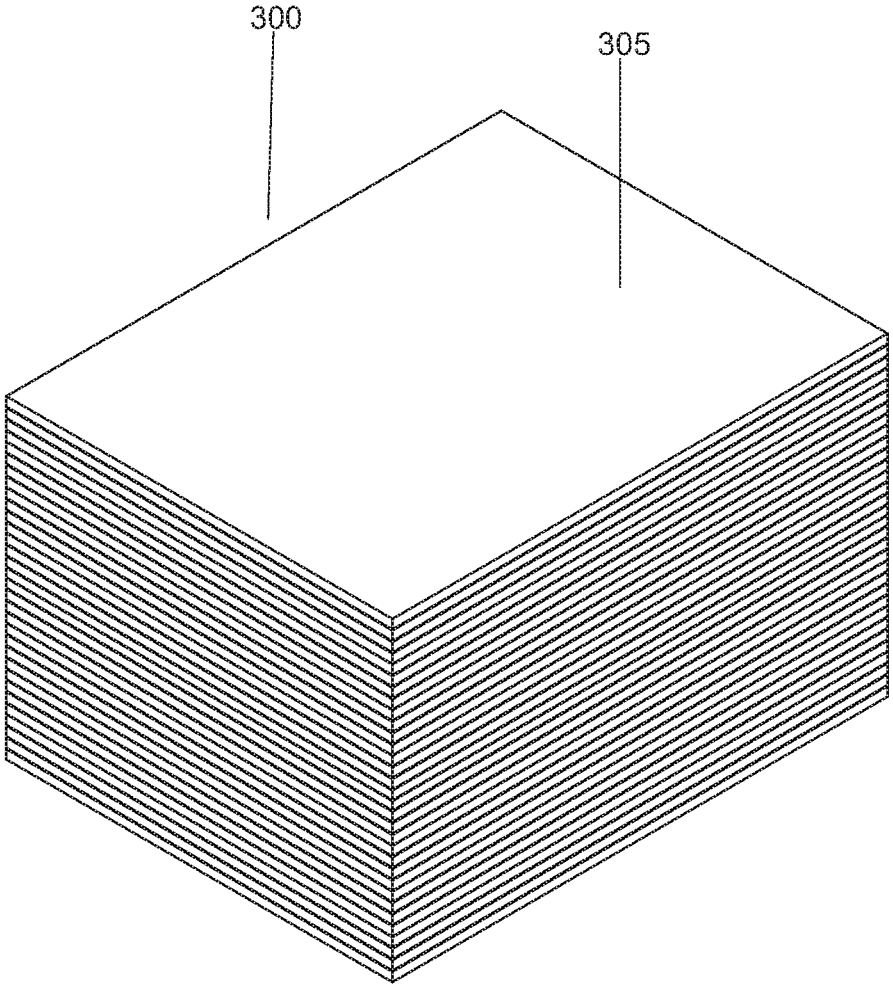
FIG. 5 is a front top perspective view of a stack of exemplary disinfectant pads attachable to a roller of an exemplary cleaning system for outsoles according to principles of the invention.

FIG. 5 conceptually illustrates a stack 300 of disinfectant pads 305. Each pad is an absorbent cleaning pad. The pad may be pre-moistened (e.g., soaked) with disinfectant and/or moistened with disinfectant before cleaning use. A pad 305 adheres to the roller 205, such as using a hook and loop fastener.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

The invention claimed is:

1. An outsole cleaning apparatus comprising:

a housing with a lid that is movable from a closed position to an open position, and, with the lid in the closed position, the housing encloses a roller and an absorbent pad removably attached to the roller, and the absorbent pad containing an absorbed liquid disinfectant, and, with the lid in the open position, the roller and absorbent pad being exposed for use in cleaning the outsole of a footwear wiped against the roller, the roller being at least about 8 inches long.

2. The outsole cleaning apparatus of claim 1 further comprising a pair of pedestals supporting the housing.

3. The outsole cleaning apparatus of claim 1 further comprising a sprayer configured to controllably supply liquid disinfectant to the absorbent pad removably attached to the roller.

4. The outsole cleaning apparatus of claim 1 further comprising a hook and loop fastener removably attaching the absorbent pad to the roller.

5. The outsole cleaning apparatus of claim 1 further comprising a foot pedal operably coupled to the lid.

6. The outsole cleaning apparatus of claim 1 further comprising a plurality of nonslip feet.

7. An outsole cleaning apparatus comprising:

a housing with a lid and a bottom, the lid being movable from a closed position to an open position, and, with the lid in the closed position, the housing encloses a roller and an absorbent pad removably attached to the roller, and the absorbent pad containing an absorbed liquid disinfectant, and, with the lid in the open position, the roller and absorbent pad being exposed for use in cleaning the outsole of a footwear wiped against the roller, the roller being at least about 8 inches long; and a support structure supporting the housing.

8. The outsole cleaning apparatus of claim 7, the support structure comprising a pair of pedestals supporting the housing.

9. The outsole cleaning apparatus of claim 7 further comprising a sprayer configured to controllably supply liquid disinfectant to the absorbent pad removably attached to the roller.

10. The outsole cleaning apparatus of claim 7 further comprising a hook and loop fastener removably attaching the absorbent pad to the roller.

11. The outsole cleaning apparatus of claim 7 further comprising a foot pedal operably coupled to the lid.

12. The outsole cleaning apparatus of claim 7 further comprising a plurality of nonslip feet attached to the bottom of the support structure.

13. An outsole cleaning apparatus comprising:

a housing with a lid and a bottom, the lid being a first hemispherical shell, and the bottom being a second hemispherical shell, and the lid being movable from a closed position to an open position, and, with the lid in the closed position, the housing encloses a roller and an absorbent pad removably attached to the roller, and the absorbent pad containing an absorbed liquid disinfectant, and, with the lid in the open position, the roller and absorbent pad being exposed for use in cleaning the outsole of a footwear wiped against the roller, the roller being at least about 8 inches long; and a support structure supporting the housing.

14. The outsole cleaning apparatus of claim 13, the support structure comprising a pair of pedestals supporting the housing.

15. The outsole cleaning apparatus of claim 13 further comprising a sprayer configured to controllably supply liquid disinfectant to the absorbent pad removably attached to the roller.

16. The outsole cleaning apparatus of claim 13 further comprising a hook and loop fastener removably attaching the absorbent pad to the roller.

17. The outsole cleaning apparatus of claim 13 further comprising a foot pedal operably coupled to the lid.

18. The outsole cleaning apparatus of claim 13 further comprising a plurality of nonslip feet attached to the bottom of the support structure.

19. The outsole cleaning apparatus of claim 14 further comprising a sprayer configured to controllably supply liquid disinfectant to the absorbent pad removably attached to the roller; and a hook and loop fastener removably attaching the absorbent pad to the roller.

20. The outsole cleaning apparatus of claim 14 further comprising a foot pedal operably coupled to the lid; and a plurality of nonslip feet attached to the bottom of the support structure.

* * * * *